US009926735B2

(12) United States Patent
Goossens et al.

(10) Patent No.: US 9,926,735 B2
(45) Date of Patent: Mar. 27, 2018

(54) TELESCOPING DOOR INTEGRATED HARDWARE

(71) Applicant: PEMKO MANUFACTURING CO., Memphi, TN (US)

(72) Inventors: Philip Anthony Goossens, Cordova, MI (US); Damond Maurice Smalls, Collierville, TN (US); Jeffrey G. Karl, Portage, MI (US)

(73) Assignee: PEMKO MANUFACTURING CO., Memphis, TN (US)

( * ) Notice: Subject to any disclaimer, the term of this patent is extended or adjusted under 35 U.S.C. 154(b) by 0 days.

(21) Appl. No.: 14/216,170

(22) Filed: Mar. 17, 2014

(65) Prior Publication Data

US 2015/0020453 A1 Jan. 22, 2015

Related U.S. Application Data

(60) Provisional application No. 61/793,779, filed on Mar. 15, 2013.

(51) Int. Cl.

| | |
|---|---|
| ***E05F 17/00*** | (2006.01) |
| *E05D 15/06* | (2006.01) |
| *E05D 15/08* | (2006.01) |

(52) U.S. Cl.

CPC ..... *E05F 17/00* (2013.01); *E05D 15/0621* (2013.01); *E05D 15/0652* (2013.01);

(Continued)

(58) Field of Classification Search

CPC .... E05F 17/00; E05F 2017/007; E05D 15/08; E05D 15/0652; E05D 15/0621; E05Y 2201/654

(Continued)

(56) References Cited

U.S. PATENT DOCUMENTS 1,960,860 A * 5/1934 Allen ..... E05F 17/00 160/184

3,118,170 A 1/1964 Zollinger (Continued)

FOREIGN PATENT DOCUMENTS

DE 199 52 264 * 6/2000
EP 0417000 A1 9/1990

(Continued)

OTHER PUBLICATIONS

Rothley Ltd, Sliding Door Gear—Herkules120 Sliding Door System—Kit for 1 door, Jan. 13, 2014, http://www.rothley.com/trade/product-details.asp?PID=1392&GPN=HERK120&amp . . . .

*Primary Examiner* — Gregory J Strimbu
(74) *Attorney, Agent, or Firm* — Dennis J. Williamson; Moore & Van Allen PLLC

(57) ABSTRACT

A sliding door assembly comprises a plurality of door panels for coordinated movement along an upper guide track. A bracket is mounted to the upper end of one of the door panels. The bracket comprises an elongated member and defines a plurality of openings for receiving fasteners and roller mechanisms. At least one roller mechanism is secured to each of the door panels and slidably received within the upper guide track. A pair of pulleys is secured to the bracket for carrying an endless cable and the door panels are secured to the cable. In a fully open position, a first outer door panel of the door panels is secured to the cable of the immediately adjacent door panel at a side of the immediately adjacent door panel opposite to the lead edge.

4 Claims, 30 Drawing Sheets

(52) U.S. Cl.
CPC ..... *E05D 15/08* (2013.01); *E05F 2017/007* (2013.01); *E05Y 2201/654* (2013.01)

(58) Field of Classification Search
USPC ..... 160/197, 200, 202, 208, 222, 226, 227, 160/37
See application file for complete search history.

(56) References Cited

U.S. PATENT DOCUMENTS

| | | | | |
|---|---|---|---|---|
| 3,738,013 | A | 6/1973 | Gregory | |
| 3,829,929 | A | 8/1974 | Foltz et al. | |
| 4,565,031 | A | 1/1986 | Sakamoto | |
| 5,884,361 | A * | 3/1999 | Richardson | E05D 15/0665 16/100 |
| 6,058,665 | A | 5/2000 | Halvorson, Jr. et al. | |
| 6,209,171 | B1 | 4/2001 | Pelletier et al. | |
| 6,289,643 | B1 | 9/2001 | Bonar | |
| 6,352,097 | B1 * | 3/2002 | Kern | E05F 15/643 160/118 |
| 6,698,138 | B1 | 3/2004 | Lin | |
| 6,983,512 | B2 | 1/2006 | De Oliveira | |
| 7,021,007 | B2 | 4/2006 | Jacobs | |
| 7,117,559 | B1 | 10/2006 | Barber | |
| 8,226,130 | B2 | 7/2012 | Alfredsson et al. | |

FOREIGN PATENT DOCUMENTS

| | | | |
|---|---|---|---|
| EP | 2 706 181 | * | 3/2014 |
| GB | 877261 | | 9/1961 |
| GB | 881202 | | 11/1961 |
| KR | 10-1182413 | * | 9/2012 |

* cited by examiner

TELESCOPING DOOR INTEGRATED HARDWARE

CROSS-REFERENCES

This application is related to U.S. provisional application No. 61/793,779, filed Mar. 15, 2013, entitled "TELESCOPING DOOR INTEGRATED HARDWARE", naming Jeffrey G. Karl as the inventor. The contents of the provisional application are incorporated herein by reference in their entirety, and the benefit of the filing date of the provisional application is hereby claimed for all purposes that are legally served by such claim for the benefit of the filing date.

BACKGROUND

A sliding door assembly is described and, more particularly, a sliding door assembly for moving a plurality of door panels in a telescoping manner with a minimum of door hardware.

A conventional sliding door assembly is typically used as a door for a closet, a bathroom, or a sliding room divider. The door is opened by manually pushing one or more door panels into a "pocket" built into the wall located adjacent to the door opening. Sliding mounting assemblies mount the door panels for movement along a horizontally extending track mounted to the inside surface of a header jam in a door opening. Each door panel is provided with roller assemblies having wheels or other slidable elements that can roll or slide within the track. Preferably, the track is secured along an upper extent of the door opening and the roller assemblies mounted to the door serve to suspend the door from the track such that the weight of the panel door is supported by the track. The roller assemblies and guide rails are concealed in the upper or lower portions of the door frame such that the roller assemblies and guide rails are not visible. Additional guide wheels or clips may be attached to the bottom edge of the door to keep it vertically aligned in the door frame.

Conventional sliding and folding door hardware requires a plurality of hangers and hanger brackets installed on a top of edge of the door panels. In a telescoping door system, pulleys and cables are also required.

There is a need to integrate the functionality of a plurality of hanger brackets for sliding and telescoping door assemblies into a single bracket for use with all required door hardware.

SUMMARY

A sliding door assembly comprising an upper guide track and a plurality of door panels having an upper end, a lower end, and an outer periphery with a top edge, a bottom edge and pair of opposing side edges. Each of the door panels is slidably received in a portion of the upper guide track for movement along the track in a first closing direction and a second opening direction. A bracket is mounted to a top edge of at least one of the plurality of door panels. At least one roller mechanism is secured to the bracket and to each of the door panels other than the at least one door panel. The at least one roller mechanisms are slidably received within the upper guide track. A pair of pulleys is secured to the bracket in a spaced relationship, the pair of pulleys carrying an endless cable for rotation around the pulleys. Means are provided for securing the door panels other than the at least one door panel to the cable. In a first position, the side edges of the door panels are contiguous and a first outer door panel is secured to the cable of the immediately adjacent door at the side edge opposite to the direction of closing movement of the door panels.

BRIEF DESCRIPTION OF THE DRAWINGS

For a more complete understanding of the present invention, reference should now be had to the embodiments shown in the accompanying drawings and described below. In the drawings.

DESCRIPTION

Certain terminology is used herein for convenience only and is not to be taken as a limitation on the invention. For example, words such as "upper," "lower," "left," "right," "horizontal," "vertical," "upward," and "downward" merely describe the configuration shown in the FIGS. Indeed, the components may be oriented in any direction and the terminology, therefore, should be understood as encompassing such variations unless specified otherwise.

Figure 1:
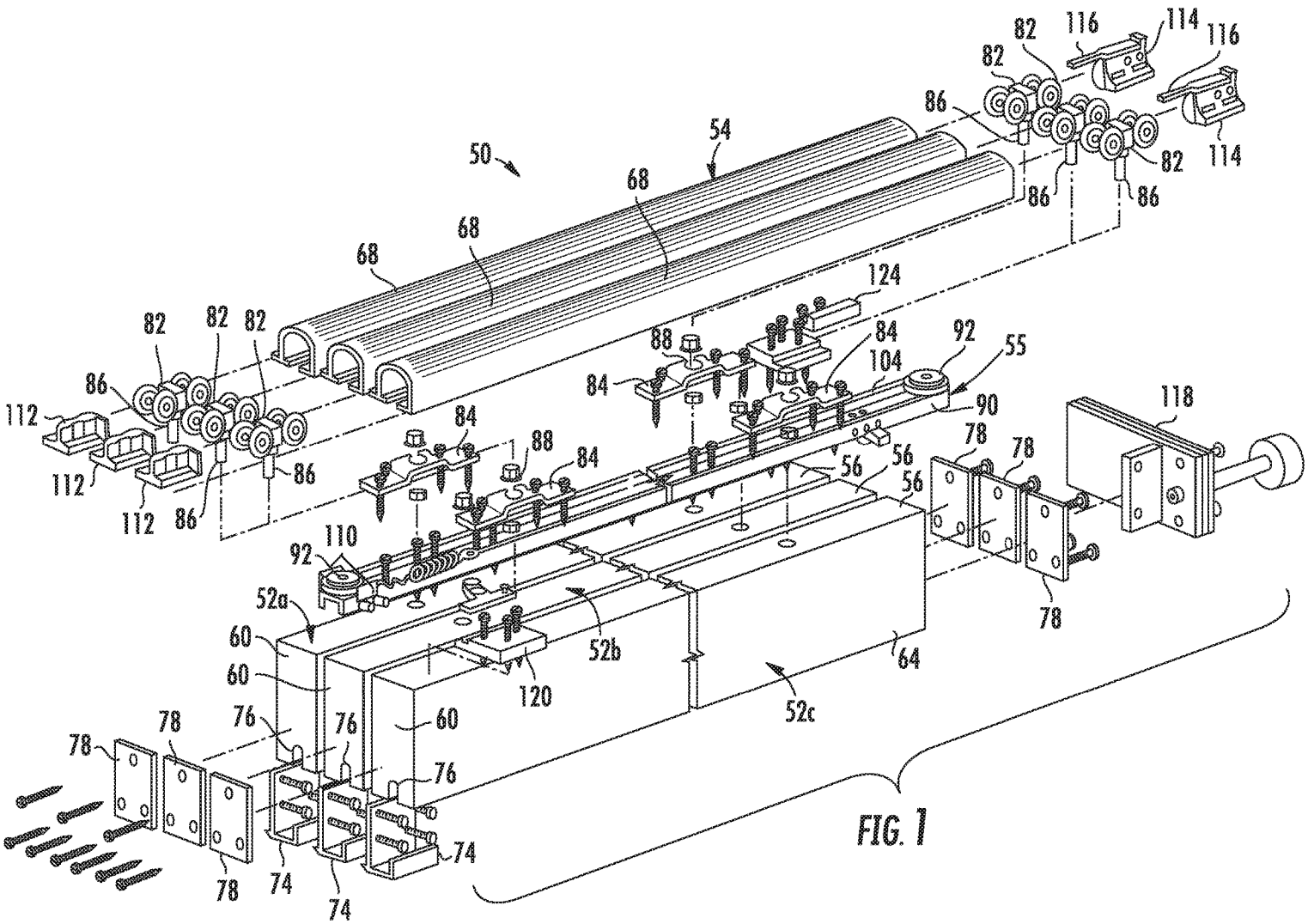
FIG. 1 is an exploded perspective view of an embodiment of a telescoping door assembly showing three door panels and an embodiment of a bracket assembly secured to a top edge of a middle door.
Figure 2:
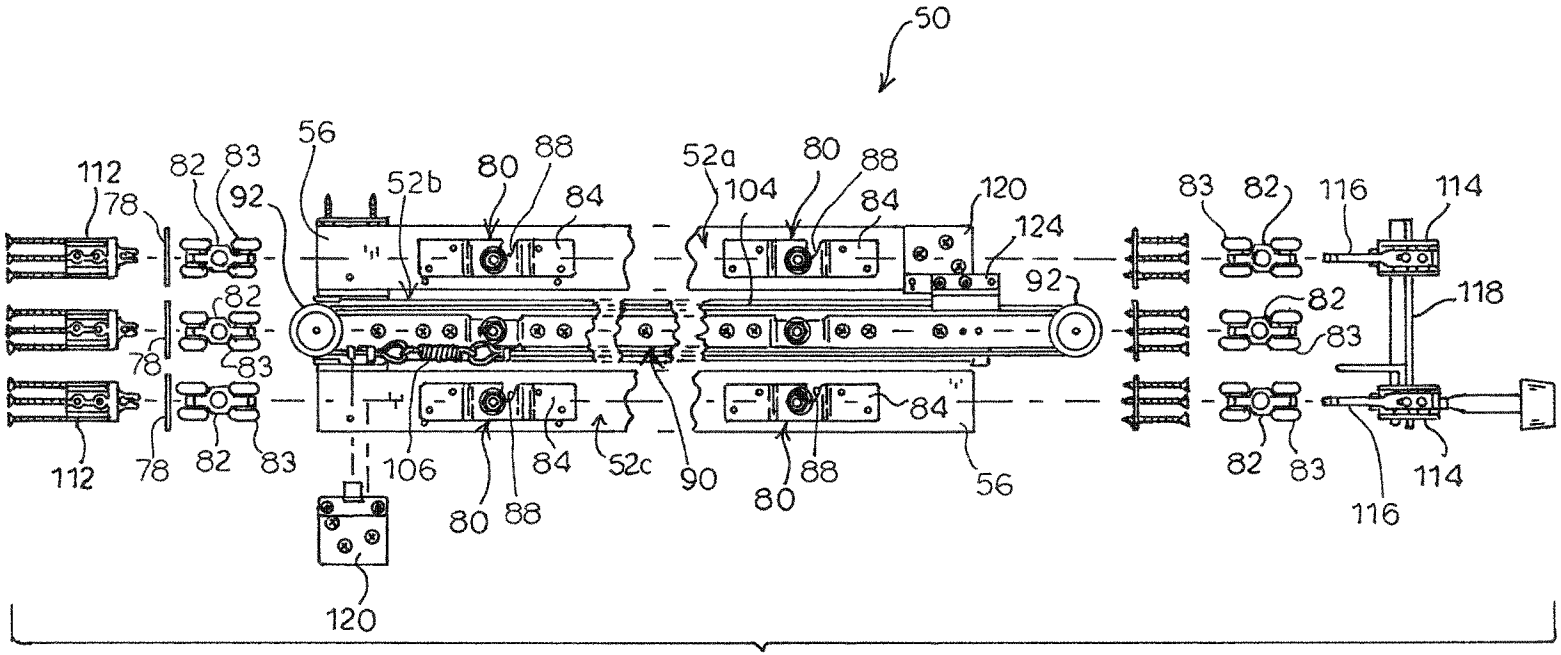
FIG. 2 is a partially exploded top plan view of the door assembly and the bracket assembly as shown in FIG. 1.
Figure 3:
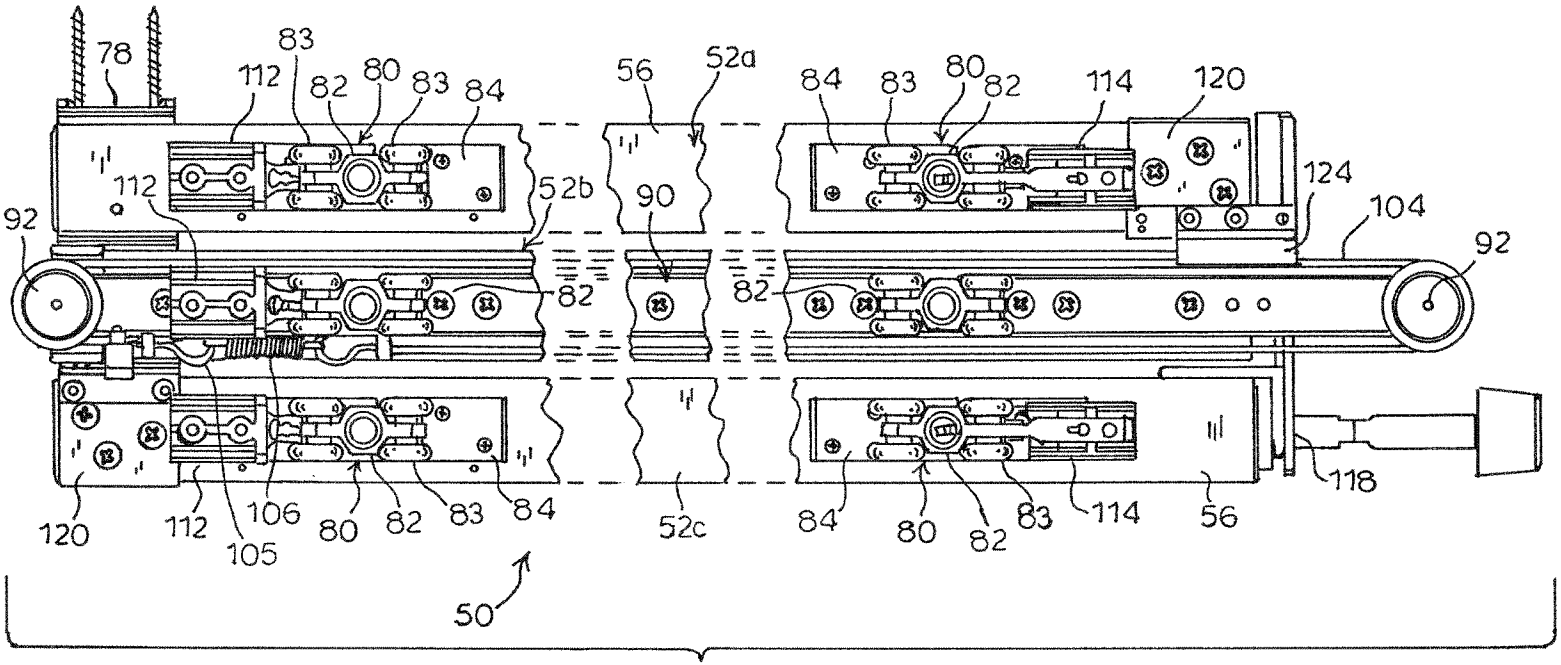
FIG. 3 is a top plan view of the door assembly and the bracket assembly as shown in FIG. 2.

Referring now particularly to the drawings, wherein like reference numerals indicate the same or similar elements throughout out the several views, an embodiment of a telescoping door assembly is shown in FIGS. 1-3 and generally designated at 50. In this embodiment, the door assembly 50 comprises three door panels 52 movable along an upper guide track 54 extending the length of an opening (not shown), and a bracket assembly 55 secured to the middle door panel 52. The door panels 52 are depicted as having a length sufficient only to allow a full drawing of all component parts of the door assembly 50. Each door panel 52 includes a top edge 56, a bottom edge 58, an outer edge 60 and an opposing inner edge 62, and major side surfaces 64. The door panels 52 can be formed from wood, a wood-polymer composite material, a polymer, glass, mirrors or any other material capable of forming a door panel or room divider.

Figure 4:
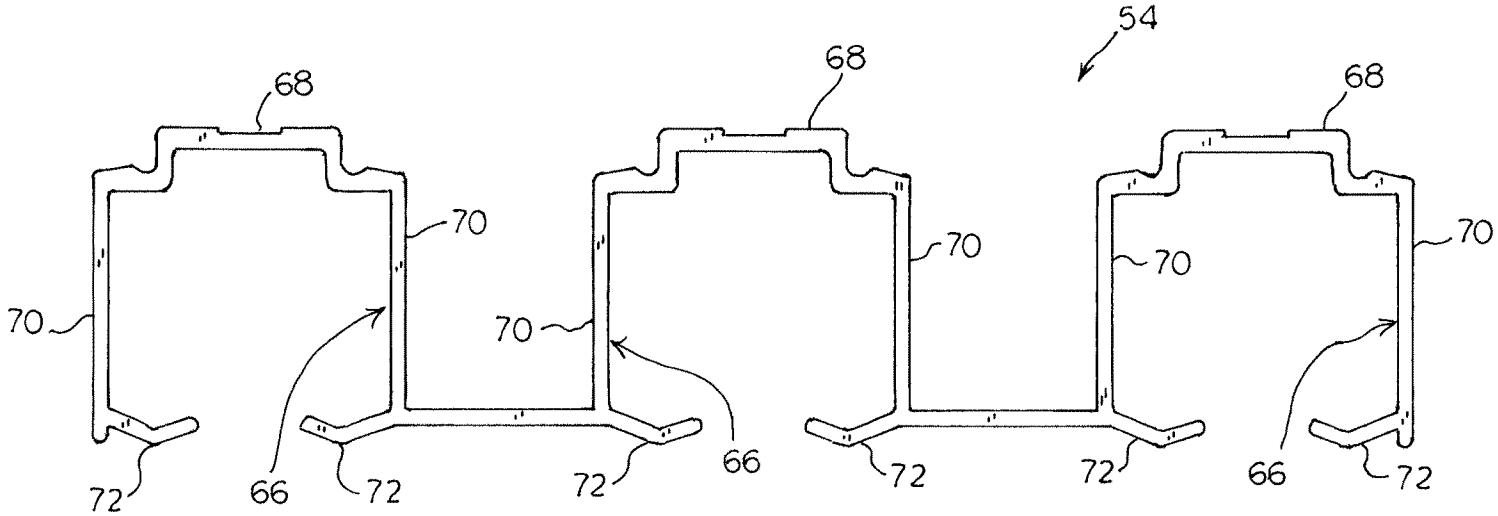
FIG. 4 is an end elevation view of a track guide for use with the door assembly as shown in FIG. 1.

Referring to FIG. 4, the upper guide track 54 is an elongated body having one or more downwardly opening longitudinal channels 66 formed therein. The guide track 54 is preferably formed from a suitable material having sufficient strength to withstand the weight of the door panels 52 without undergoing deformation. The guide track 54 is adapted to be mounted in parallel relation to the overhead structure (not shown) defining the door opening. The guide track 54 includes an elongated base wall 68 which is configured to be fixed to the overhead structure by any suitable means, for example, a series of longitudinally spaced fasteners, such as screws or the like. A plurality of laterally spaced walls 70 extend downwardly from the base wall 68 to form the channels 66. Each channel 66 is defined by a pair of the walls 70 and the base wall 68. Although three channels 66 are shown, it is understood two channels can be provided, or more than three channels can be provided depending upon the number of door panels. The terminal edges of each end wall includes an inwardly extending flange 72. The flanges 72 are adapted to engage the wheels of roller assemblies on the door panels 52.

A J-shaped door guide 74 is provided for each door panel 52 to guide the bottom edges 58 of the door panels 52 during their sliding movement. The door guides 74 are secured to the door frame or to the door panel surface 64 adjacent to the lower outer edge 60 of the immediately adjacent door panel 52. As seen in FIGS. 1 and 2, the bottom edges 58 of the door panels 52 define longitudinal grooves 76 for slidingly receiving the shorter leg of the door guides 74 and guiding linear movement of the door panels 52. An endplate 78 is secured to the outer edge 60 and the inner edge 62 of the door panels 52 adjacent their bottom edge 58. The endplates 78 close the ends of the longitudinal grooves 76 providing an endpoint for the relative sliding movement of the door panels 52.

A pair of roller assemblies 80 is mounted to the top edge 56 of each door panel 52. Each roller assembly 80 includes a carriage assembly 82, including wheels 83 configured to be movable horizontally along the guide track 54. For the outer door panels 52 of the door assembly 50 shown in FIGS. 1-3, the roller assemblies 80 also include a support member 84 configured to be mounted to the top edge 56 of the door panels 52. The carriage assembly 82 includes a vertically extending locking post 86 and the support member 84 defines an arcuate opening 88 for securely receiving the locking post 86 therein. Roller assemblies of this type are well known in the art. The pairs of roller assemblies 80 function to mount the door panels 52 for movement along the guide track 54 between the sides of the structure (not shown) defining the door opening. The channels 66 of the guide track 54 are sized to receive the roller assemblies 80 therein such that the wheels 83 of the roller assemblies 80 contact opposing inward flanges 72 of the walls 70 defining the channel 66.

Figure 5:
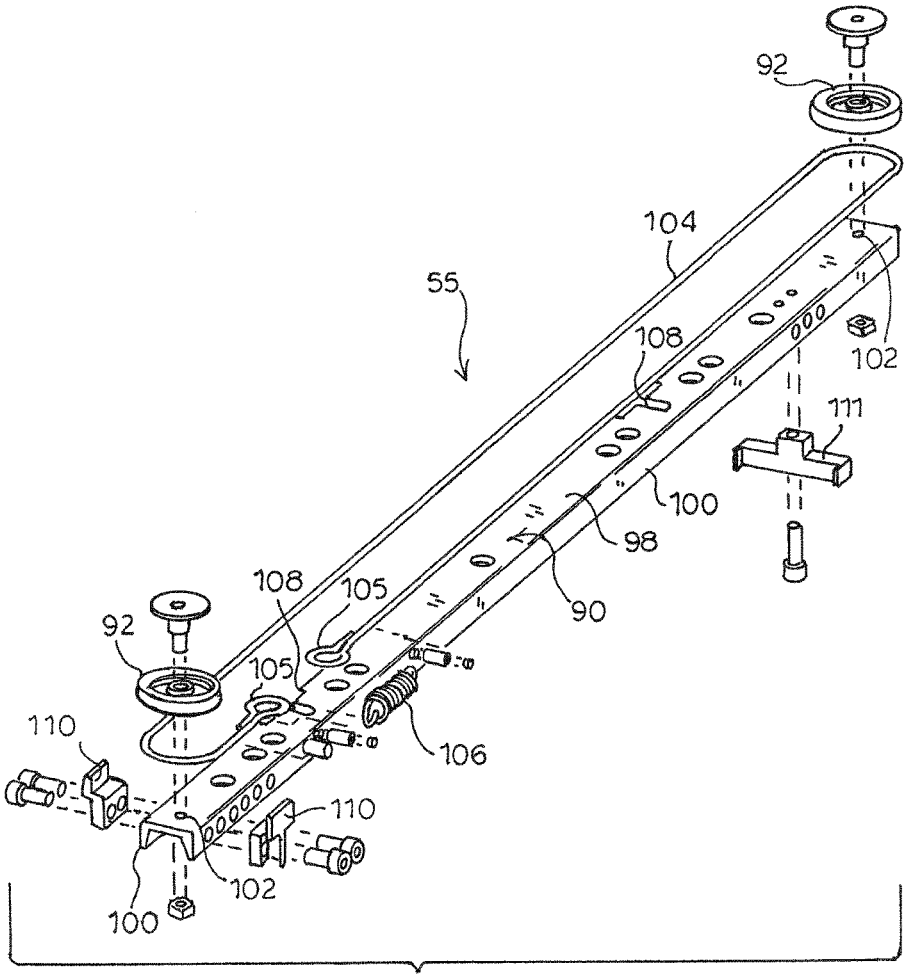
FIG. 5 is an exploded perspective view of the bracket assembly as shown in FIG. 1.
Figure 6:
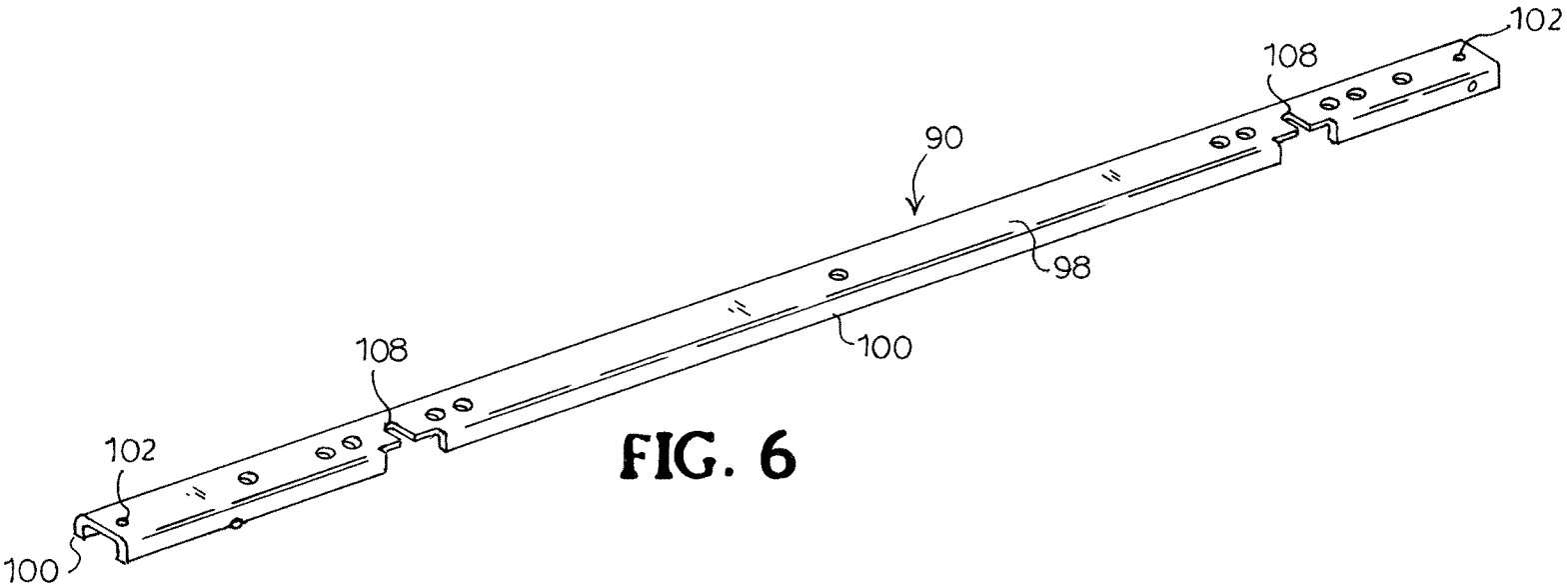
FIG. 6 and FIG. 7 are a perspective view and a top plan view, respectively, of a bracket for use in the bracket assembly shown in FIG. 5.
Figure 7:
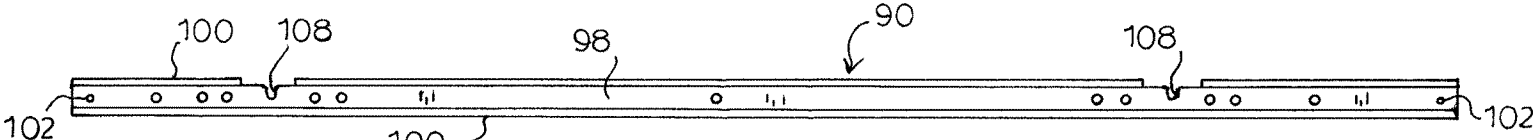

An embodiment of a bracket assembly 55 for use with the door assembly 50 is shown in FIG. 5. The bracket assembly 55 comprises a monolithic bracket 90, rotatable pulleys 92 at each end of the bracket 90, and a cable 94 extending around the pulleys 92. Referring to FIGS. 6 and 7, the bracket 90 comprises an elongated base member 96 sized and shaped to fit on the top edge 56 of a door panel 52. The base member 96 includes a web 98 and two walls 100 depending from the longitudinal edges of the web. A plurality of holes are provided through the bracket 90 for receiving fasteners for securing the bracket to the top edge 56 of the middle door panel 52. The bracket 90 is configured to extend beyond the inner edge 62 of the door panel 52. The bracket 90 has an opening 102 at each end for receiving the pulley axles. A cable 104 is disposed in the circumferential grooves of the pulleys 92. Each end of the cable 104 includes a loop 105 for receiving the opposite ends of a coil spring 106. Two slots 108 are provided longitudinally inwardly from the pulley axle openings 102 for securely receiving a pair of carriage assemblies 82. A stop 110 is secured at the outer end of the bracket 90. The stop 110 comprises two brackets. Each bracket is secured to one of the walls 100 of the web 98, each of the brackets having a flange extending upwardly transversely with respect to the bracket 90.

A T-shaped alignment guide 110 is secured between the bracket 90 and the inner top edge 56 of the door panel 52. The alignment guide 110 defines a shallow pocket for receiving the trailing inner edge 62 of the door panel 52. This arrangement ensures proper alignment of the bracket 90 with the associated door panel 52. The base member 96 may also have alignment tabs for various size door panels and applications for ease of installation. The alignment tabs accommodate a range of door sizes from about 1.5 feet wide to about 6 feet wide. The bracket 90 may be formed from extruded aluminum, roll-formed aluminum, roll-formed steel or other materials that are capable of suitable for use as the bracket fitted onto the door panel 52.

Figure 8:
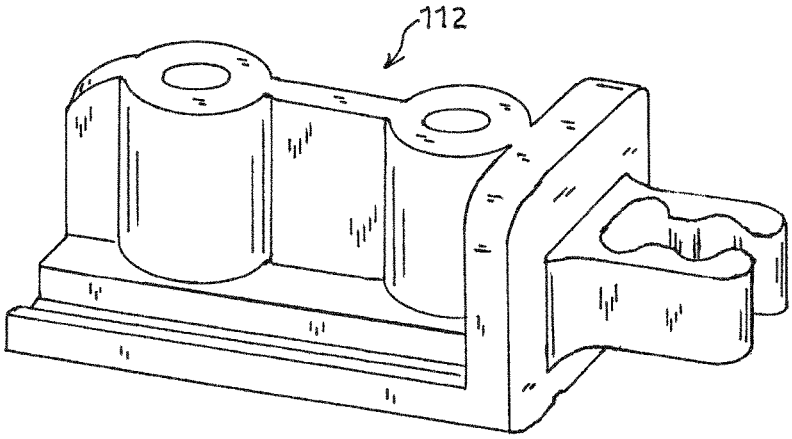
FIG. 8 is a perspective view of an end stop for use in the door assembly as shown in FIG. 1
Figure 9:
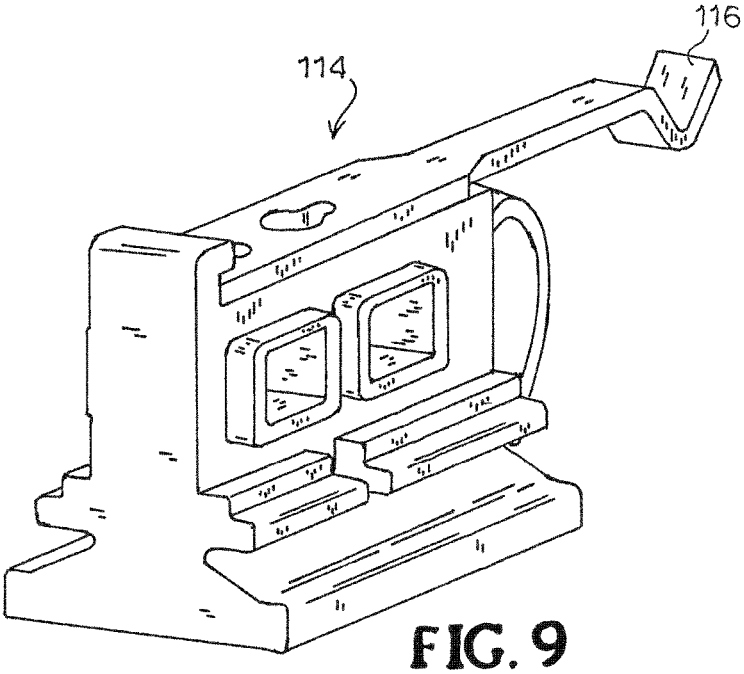
FIG. 9 is a perspective view of a retaining clip stop for use in the door assembly as shown in FIG. 1.
Figure 10:
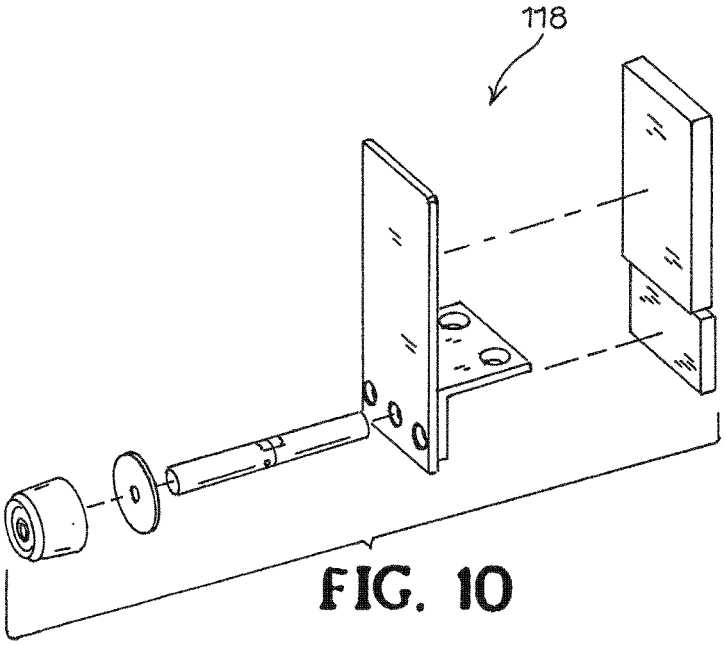
FIG. 10 is an exploded perspective view of a backstop assembly for use in the door assembly as shown in FIG. 1.

An outer end stop 112 (FIG. 8) is compression fitted into the end of each channel 66. The end stops 112 conceal the open ends of the channels 66 and provide a hard stop for the carriage assemblies 82. Similarly, retaining clip stops 114 (FIG. 9) are fitted into the open inner ends of the channels 66 for providing a hard stop for the carriage assemblies 82 at the inner end of the channels 66. Each retaining clip stop 114 includes a resilient leg 116 extension sized for receiving a wheel. A backstop assembly 118 (FIG. 10) is also provided in the pocket of the door frame for a cushioned stop of each door panel 52 of the door assembly 50 at its innermost position.

Figure 11:
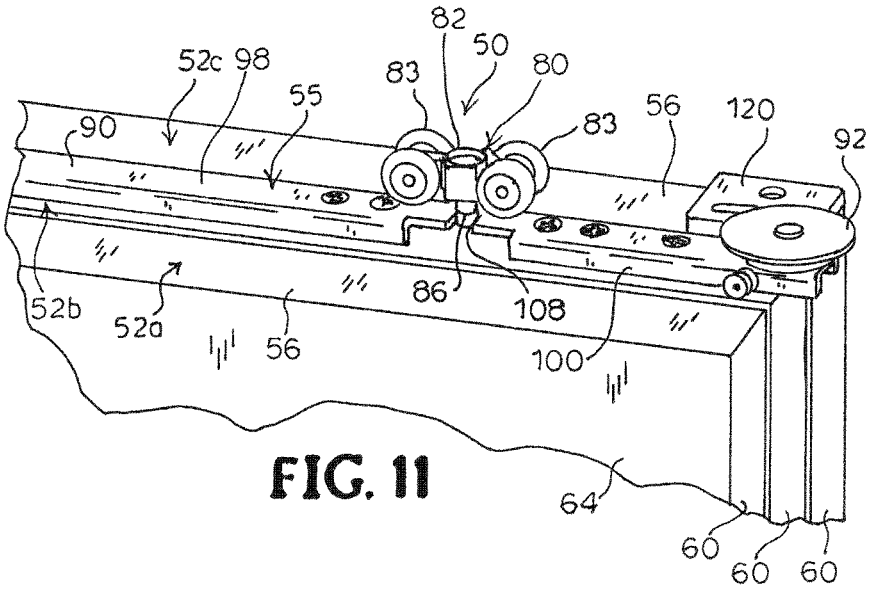
FIG. 11 is a close-up perspective view of an outer end of the door assembly and bracket assembly as shown in FIG. 1.
Figure 12A:
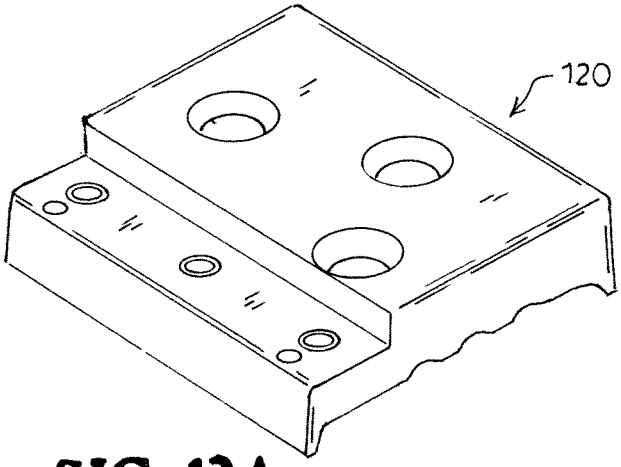
FIG. 12A is a perspective view of a clamp base for use in the door assembly as shown in FIG. 1.
Figure 12B:
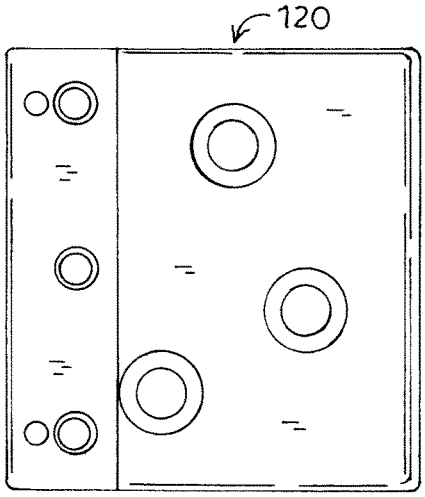
FIG. 12B is a top plan view of the clamp base as shown in FIG. 12A.
Figure 12D:
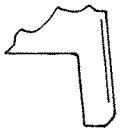
FIG. 12D is a close-up view of a portion of the clamp base as shown in FIG. 12C.
Figure 12C:
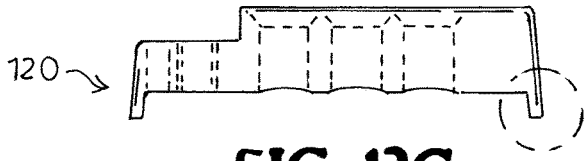
FIG. 12C is a side elevation view of the clamp base as shown in FIG. 12A with internal structure shown in phantom.
Figure 13A:
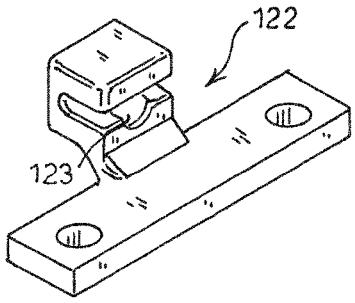
FIG. 13A is a front perspective view of a first embodiment of a cable clamp for use in the door assembly as shown in FIG. 1.
Figure 13B:
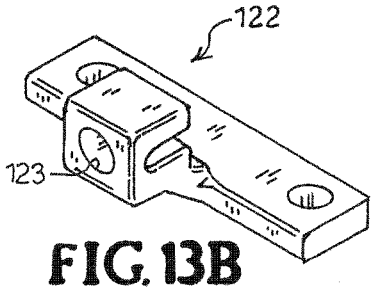
FIG. 13B is a rear perspective view of the cable clamp as shown in FIG. 13A.
Figure 13E:
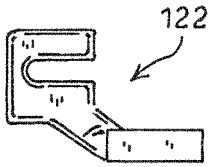
FIG. 13E is a side elevation view of the cable clamp as shown in FIG. 13A.
Figure 13C:
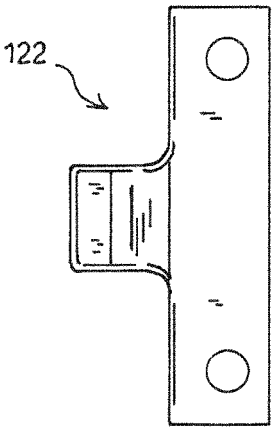
FIG. 13C is a top plan view of the cable clamp as shown in FIG. 13A.
Figure 13D:
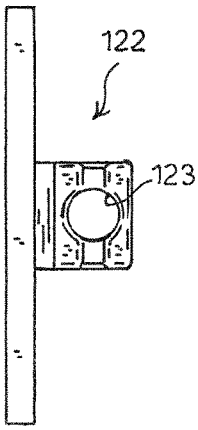
FIG. 13D is a front elevation view of the cable clamp as shown in FIG. 13A.
Figure 14A:
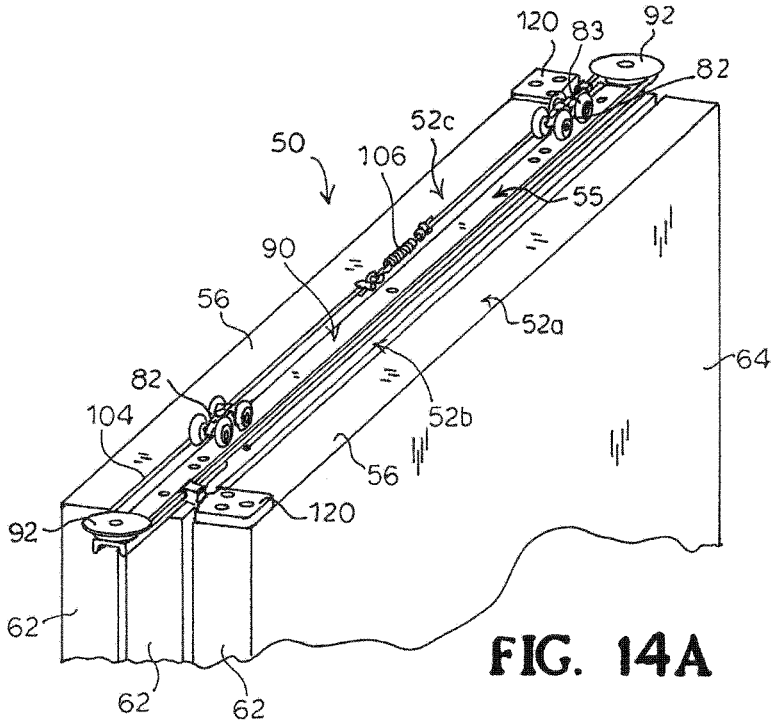
FIG. 14A is a perspective view of an inner end of the door assembly and bracket assembly as shown in FIG. 1 with the roller assemblies removed from the outer door panels.
Figure 14B:
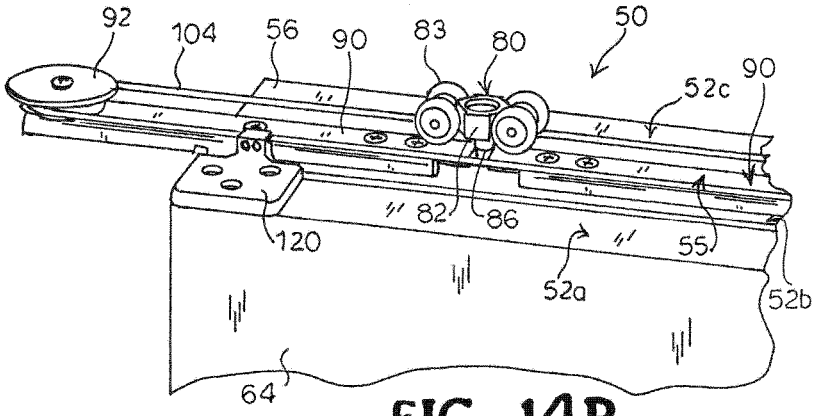
FIG. 14B is a close-up perspective view of the inner end of the door assembly as shown in FIG. 14A.
Figure 15A:
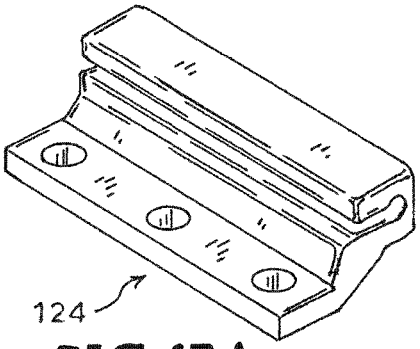
FIG. 15A is a front perspective view of a second embodiment of a cable clamp for use in the door assembly as shown in FIG. 1.
Figure 15B:
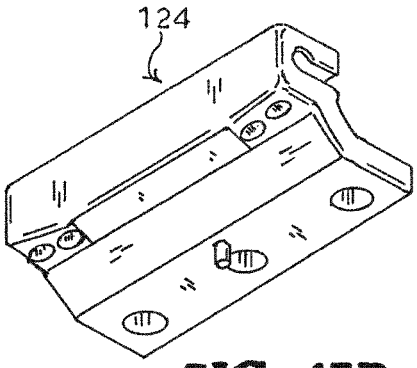
FIG. 15B is a rear perspective view of the cable clamp as shown in FIG. 15A.
Figure 15C:
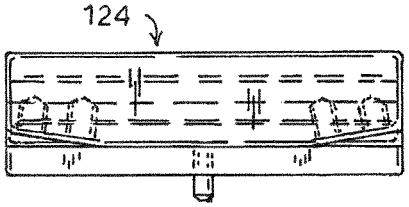
FIG. 15C is a rear elevation view of the cable clamp as shown in FIG. 15A with internal structure shown in phantom.
Figure 15D:
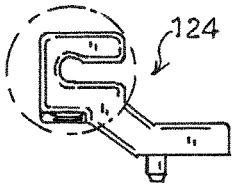
FIG. 15D is a side elevation view of the cable clamp as shown in FIG. 15A.
Figure 15E:
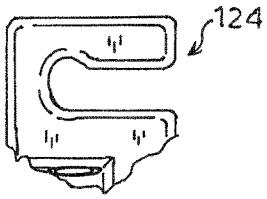
FIG. 15E is a close-up view of the cable clamp as shown in FIG. 15D.
Figure 15F:
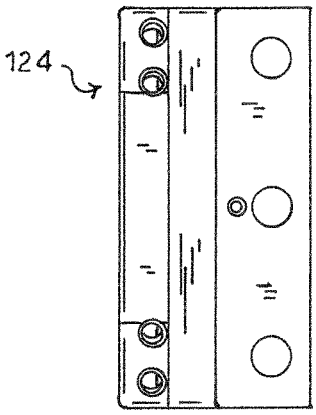
FIG. 15F is a bottom plan view of the cable clamp as shown in FIG. 15A.
Figure 16A:
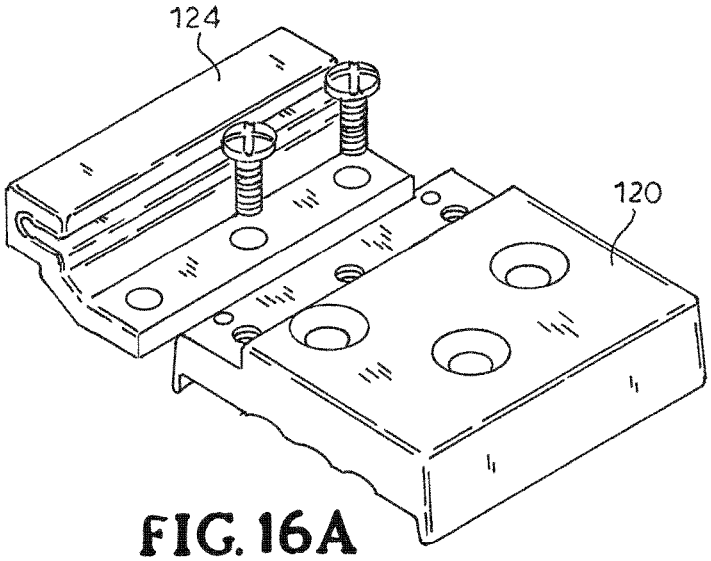
FIG. 16A is an exploded perspective view of the combined clamp base as shown in FIG. 12 and the cable clamp as shown in FIG. 15 in a first position.
Figure 16B:
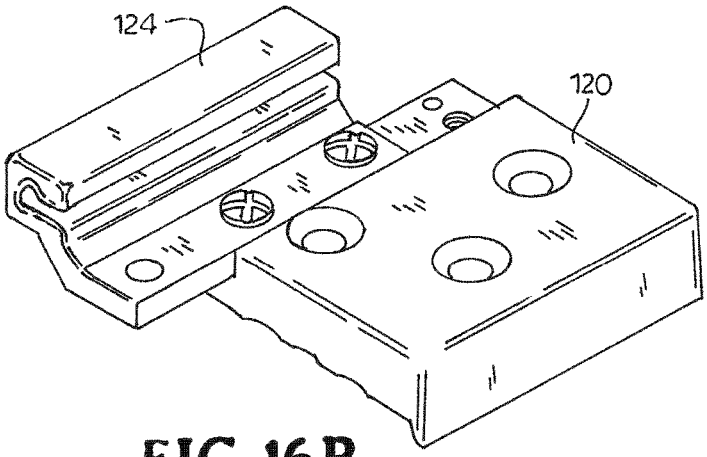
FIG. 16B is a perspective view of the combined clamp base and cable clamp as shown in FIG. 16A.
Figure 16C:
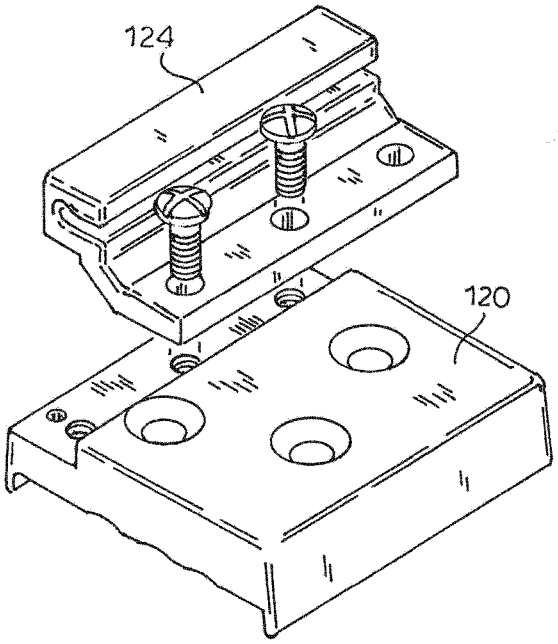
FIG. 16C is an exploded perspective view of the combined clamp base and cable clamp as shown in FIG. 16A in a second position.
Figure 16D:
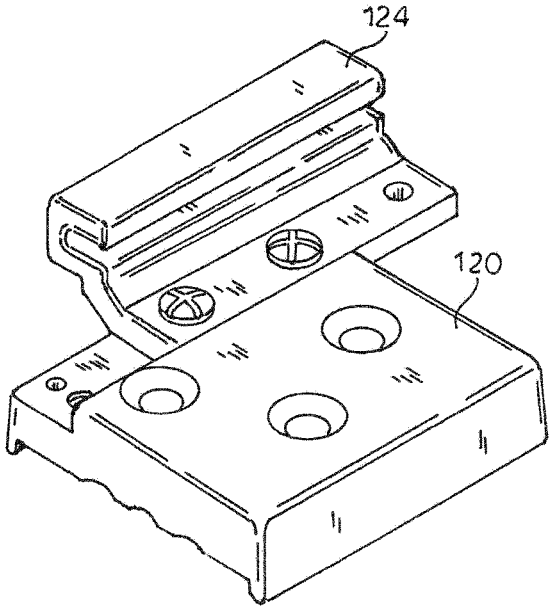
FIG. 16D is a perspective view of the combined clamp base and the cable clamp as shown in FIG. 16A.
Figure 16E:
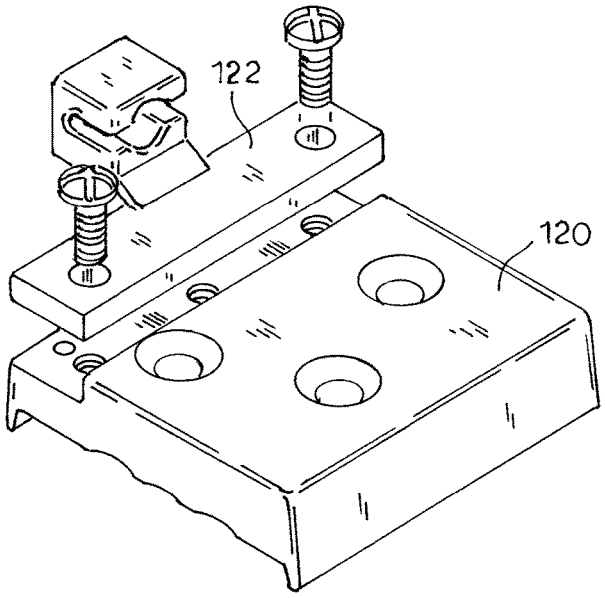
FIG. 16E is an exploded perspective view of the combined clamp base as shown in FIG. 12 and the cable clamp as shown in FIG. 13.
Figure 16F:
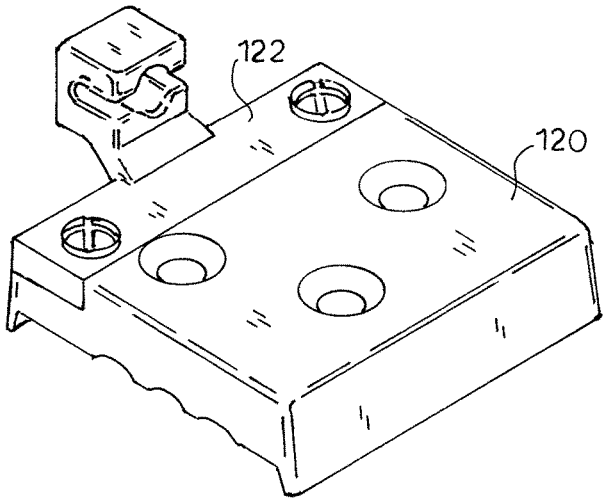
FIG. 16F is a perspective view of the combined clamp base and cable clamp as shown in FIG. 16E.
Figure 16G:
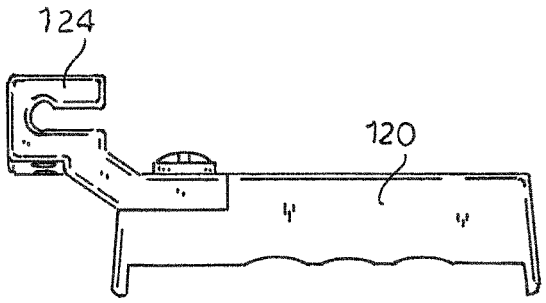
FIG. 16G is a side elevation view of the combined clamp base and cable clamp as shown in FIG. 16B.
Figure 16H:
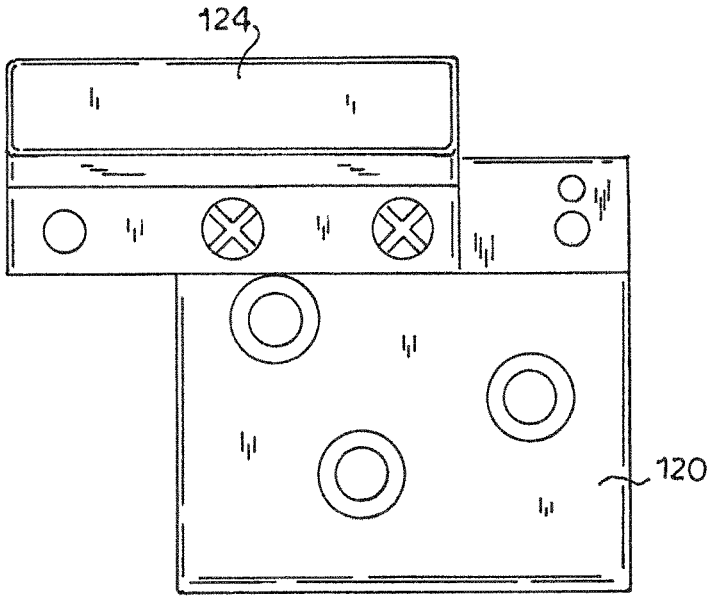
FIG. 16H is a top plan view of the combined clamp base and cable clamp as shown in FIG. 16B.
Figure 17:
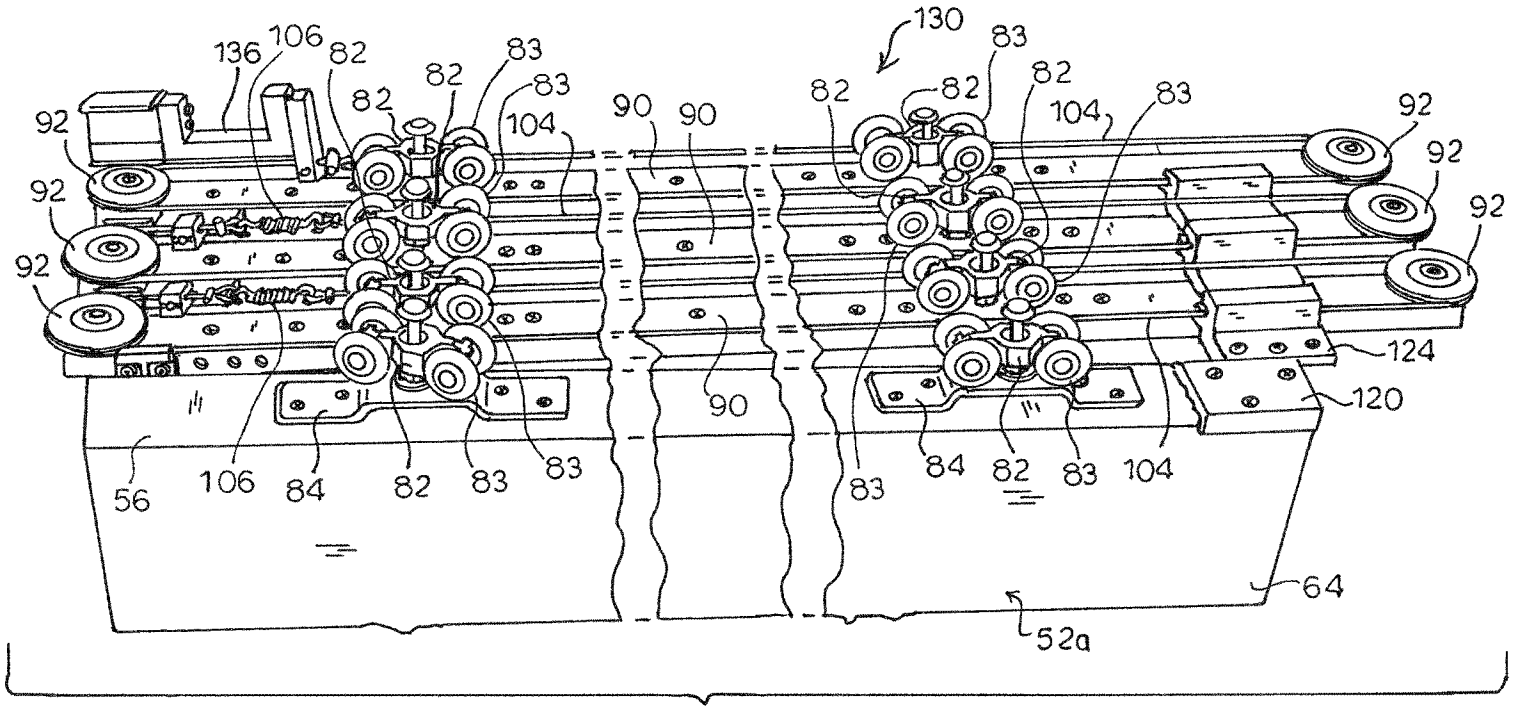
FIG. 17 is a side perspective view of another embodiment of a telescoping door assembly in a first position showing four door panels and the bracket assembly as shown in FIG. 1 secured to top edges of three of the door panels.

Referring now to FIG. 11, the outer edges 60 of the door panels 52 are shown with the leading door panel 52 in the foreground. The trailing door panel 52 includes a cable clamp base 120 secured by screws to the outer end of the top edge 56 of the door panel 52. A first cable clamp 122 (FIG. 12) is secured to the cable clamp base 120. The first cable clamp 122 defines a circular opening 123 for receiving a pin secured to the cable 104 such that the trailing door panel 52 moves with the cable 104. Referring now to FIG. 17, a second cable clamp 124 is shown secured to the cable clamp base 120 at the inner end of the top edge 56 of the leading door 52. The second cable clamp 124 defines a groove 125 for receiving the cable 104. A plurality set screws extending into the groove 125 fix the cable 104 to the second cable clamp 124 for securing the inner end of the leading door panel 52 to the cable 104.

In use, the door panels 52 are aligned and contiguous in their innermost position, for example, in the pocket of a wall. When the leading door panel 52 is pulled from the pocket and along the guide track 54, the cable 104 will rotate around the pulleys 92 because the leading door panel 52 is secured to the cable 104 by the second cable clamp 124. In addition, because the trailing door panel 52 is fixed to the cable 104 by the first cable clamp 122, the middle door panel 52 will also advance at the same rate as the leading door. Thus, the position of the leading door panel relative to the middle door panel will change at the same rate as the relative position of the middle door 52 to the trailing door panel 52. This arrangement provides for the telescoping effect to the outward movement of the door panels 52. Eventually, the leading door panel 52 will reach the limit of its outward movement allowed by the cable 104 and the stop. At this point, continued outward movement of the door panels 52 will pull the trailing door 52 from the pocket. Returning the door panels 52 to the pocket is in the reverse order.

The sliding door assembly 50 described herein can be used as door system for a closet including but not limited to a walk-in closet and a divider for sub-dividing a room or space into more than one smaller spaces. It is contemplated that the sliding door assembly 50 can have varying heights and widths, which are dependent upon the size opening of the closet or the ceiling height of the space.

Figure 18:
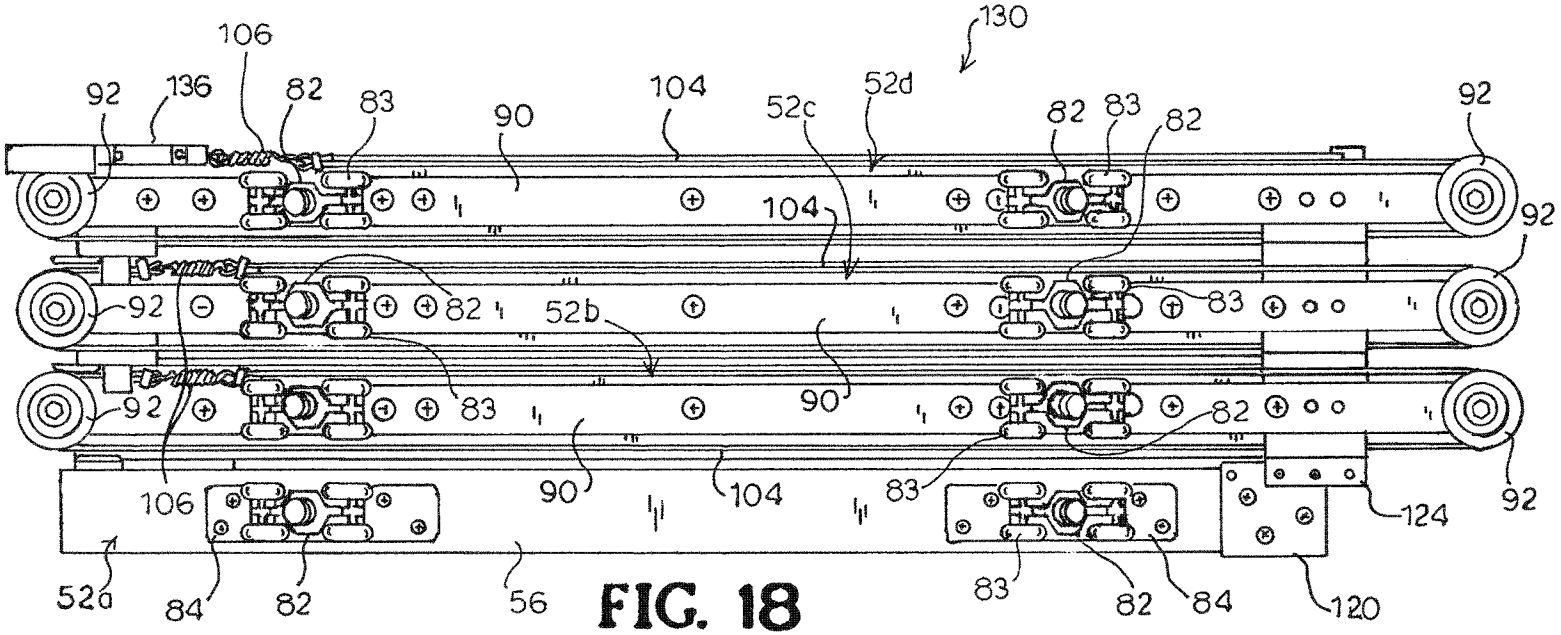
FIG. 18 is a top plan view of the embodiment of the telescoping door assembly as shown in FIG. 17.
Figure 19A:
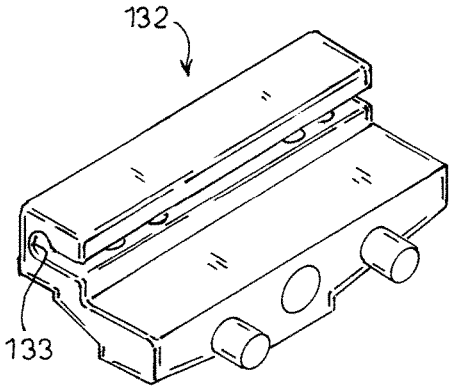
FIG. 19A is a front perspective view of a third embodiment of a cable clamp for use in the door assembly as shown in FIG. 17.
Figure 19B:
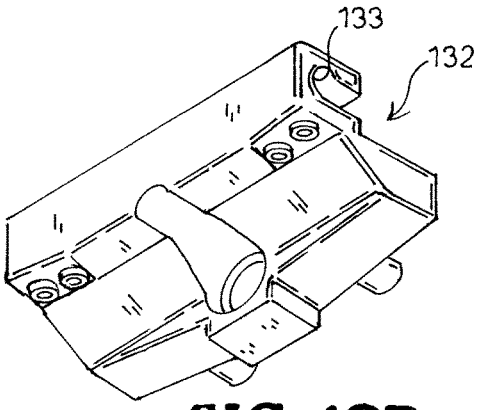
FIG. 19B is a rear perspective view of the cable clamp as shown in FIG. 19A.
Figure 19C:
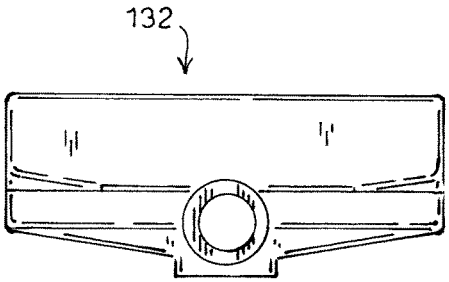
FIG. 19C is a rear elevation view of the cable clamp as shown in FIG. 19A.
Figure 19D:
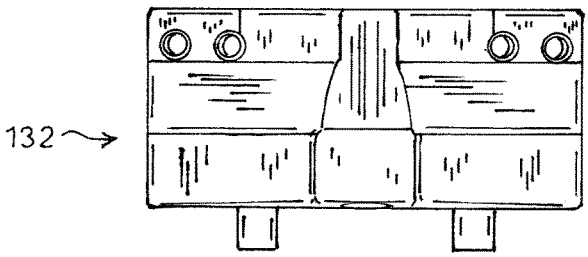
FIG. 19D is a bottom plan view of the cable clamp as shown in FIG. 19A.
Figure 19E:
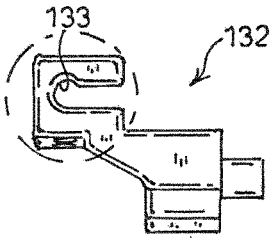
FIG. 19E is a side elevation view of the cable clamp as shown in FIG. 19A.
Figure 19F:
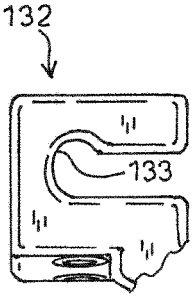
FIG. 19F is a close-up view of the cable clamp as shown in FIG. 19E.
Figure 20A:
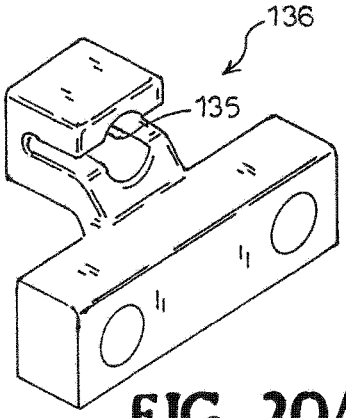
FIG. 20A is a front perspective view of a fourth embodiment of a cable clamp for use in the door assembly as shown in FIG. 17.
Figure 20B:
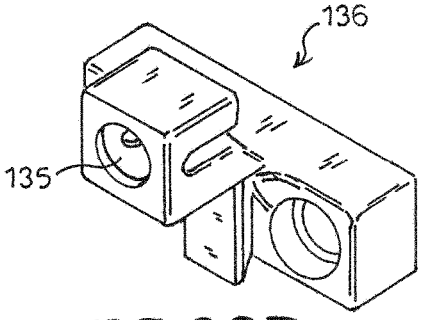
FIG. 20B is a rear perspective view of the cable clamp as shown in FIG. 20A.
Figure 20C:
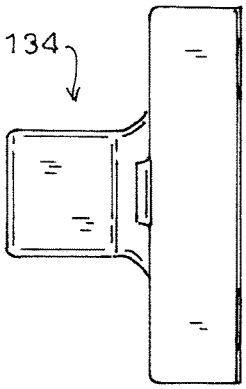
FIG. 20C is a bottom plan view of the cable clamp as shown in FIG. 20A.
Figure 20D:
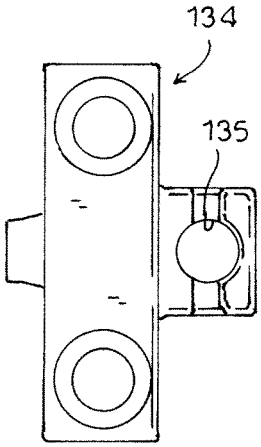
FIG. 20D is a front elevation view of the cable clamp as shown in FIG. 20A.
Figure 20E:
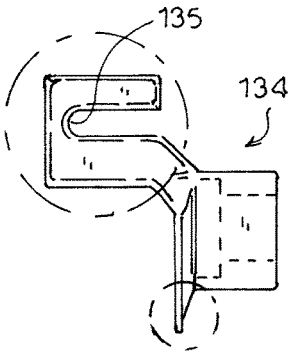
FIG. 20E is a side elevation view of the cable clamp as shown in FIG. 20A.
Figure 20F:
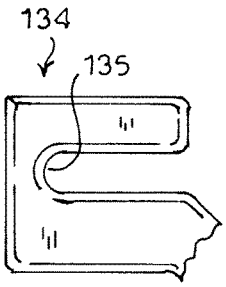
FIG. 20F is a close-up view of a first portion of the cable clamp as shown in FIG. 20E.
Figure 20G:
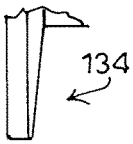
FIG. 20G is a close-up view of a second portion of the cable clamp as shown in FIG. 20E.

Another embodiment of a telescoping door assembly is shown in FIGS. 16 and 17 and generally designated at 130. In this embodiment, the door assembly 130 comprises four door panels 52 movable along an upper guide track (not shown) extending the length of an opening. In this embodiment, a bracket assembly 55 is secured to the top edge 56 of the two middle door panels 52 and the trailing door panel 52. A second cable clamp 124 is secured to a cable clamp base 120 at the inner end of the top edge 56 of the leading door panel 52 and fixed to the cable 104 of the first middle door 52. The first middle door panel 52 includes a cable clamp (FIG. 18) secured by screws to the bracket 90 adjacent the inner edge 62 of the first middle door panel 52. A plurality of set screws extend into the groove 133 to fix the third cable clamp 132 on the first middle door panel 52 to the cable 104 of the second middle door panel 52 for securing the inner end of the first middle door panel 52 to the cable 104. The second middle door panel 52 includes a fourth cable clamp 134 (FIG. 19) secured by screws to the bracket 90 adjacent the outer edge 60 of the second middle door panel 52. The fourth cable clamp 134 defines a circular opening 135 for receiving a pin secured to the cable 104 of the first middle door panel 52 such that the second middle door 52 moves with the cable 104 of the first middle door 52. In addition, the second middle door panel 52 includes a third cable clamp 132 secured by screws to the bracket 90 adjacent the inner edge 62 of the second middle door panel 52. A plurality of set screws extend into the groove to fix the third cable clamp 132 on the inner end of the second middle door panel 52 to the cable 104 on the trailing door panel 52.

Figure 21A:
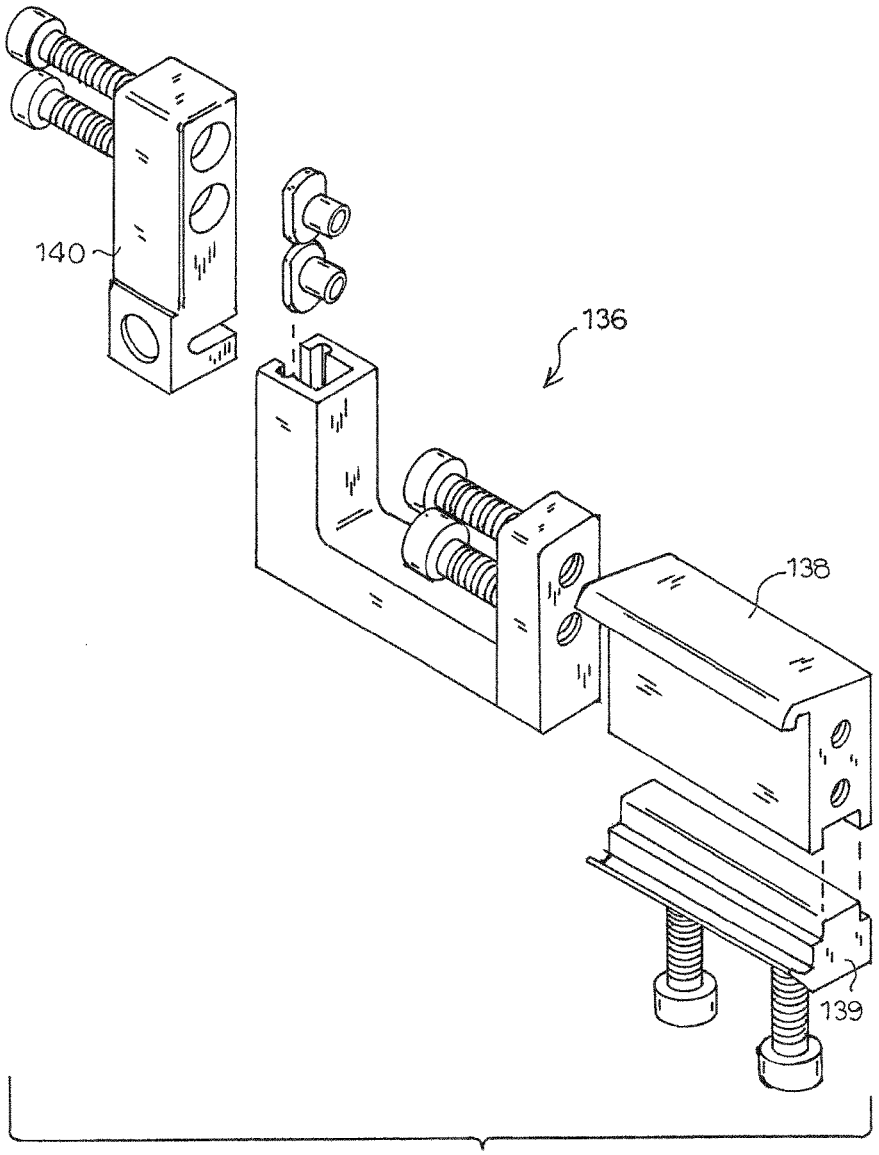
FIG. 21A is an exploded perspective view of a fifth embodiment of a cable clamp for use in the door assembly as shown in FIG. 17.
Figure 21B:
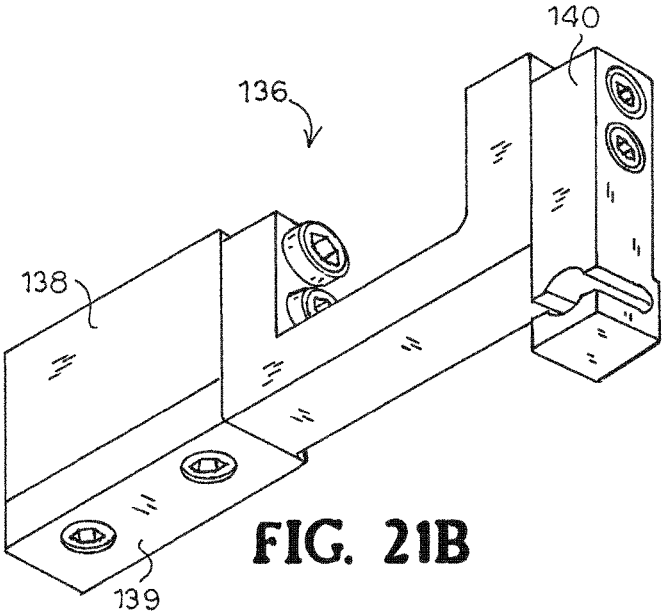
FIG. 21B is a perspective view of the cable clamp as shown in FIG. 21A.
Figure 21C:
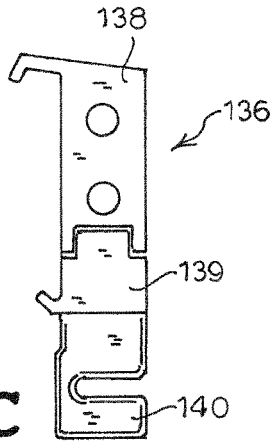
FIG. 21C is an end elevation view of the cable clamp as shown in FIG. 21A.
Figure 21D:
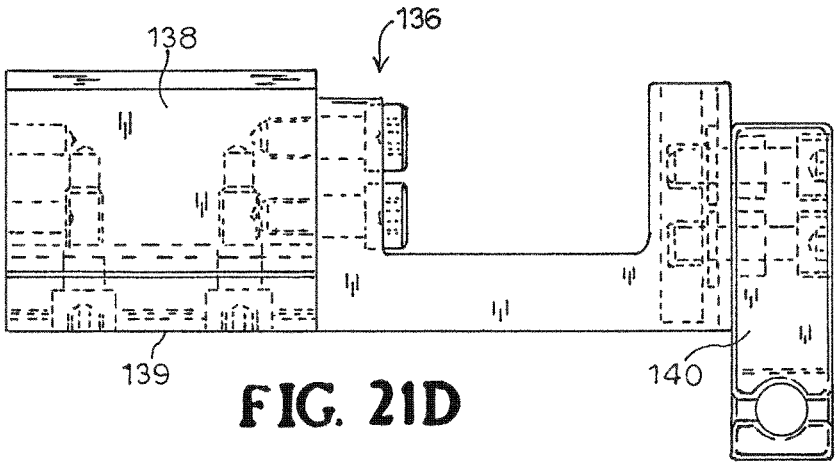
FIG. 21D is a side elevation view of the cable clamp as shown in FIG. 21A with internal structure shown in phantom.
Figure 21E:
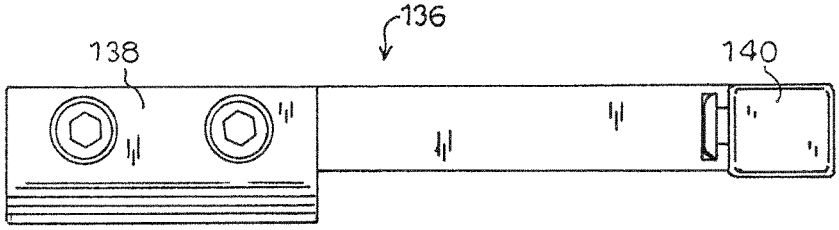
FIG. 21E is a bottom plan view of the cable clamp as shown in FIG. 21A.

Referring to FIG. 21A, a fifth embodiment of a cable clamp 136 is shown. This cable clamp comprises four pieces, including two pieces 138, 139 which together define a C-shaped aperture for slidingly receiving a portion of a channel 66 of the guide track 54. In use, the fifth embodiment of the cable clamp 136 is fixed to the channel 66 carrying the trailing door panel 52. The fifth embodiment of the cable clamp 136 includes a clamp portion 140 defining an opening 141 for receiving a pin secured to the cable 104 on the trailing door panel 52.

Figure 22:
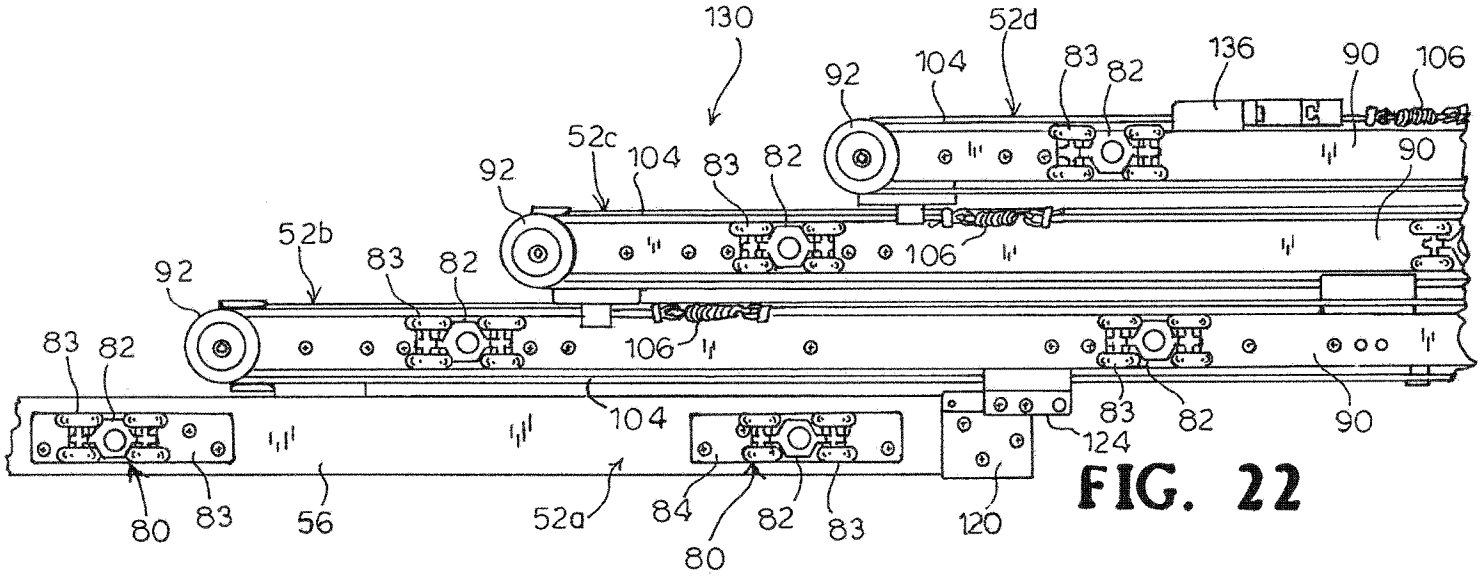
FIG. 22 is a top plan view of the embodiment of the telescoping door assembly as shown in FIG. 17 in a second position.
Figure 23:
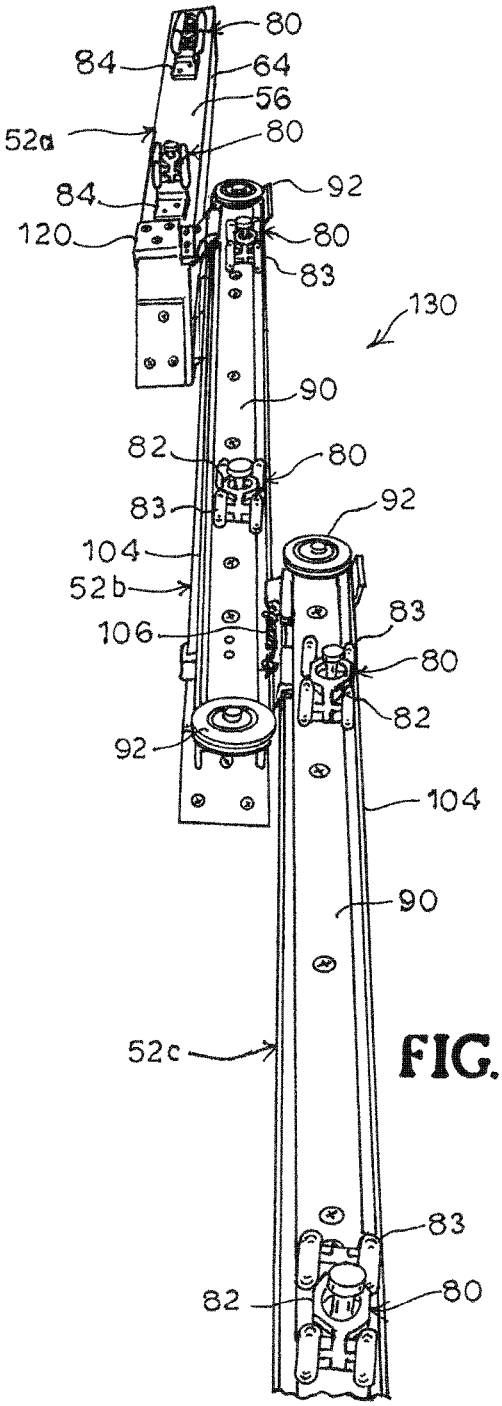
FIG. 23 is a partial outer perspective view of the embodiment of the telescoping door assembly as shown in FIG. 17 in a third position.
Figure 24:
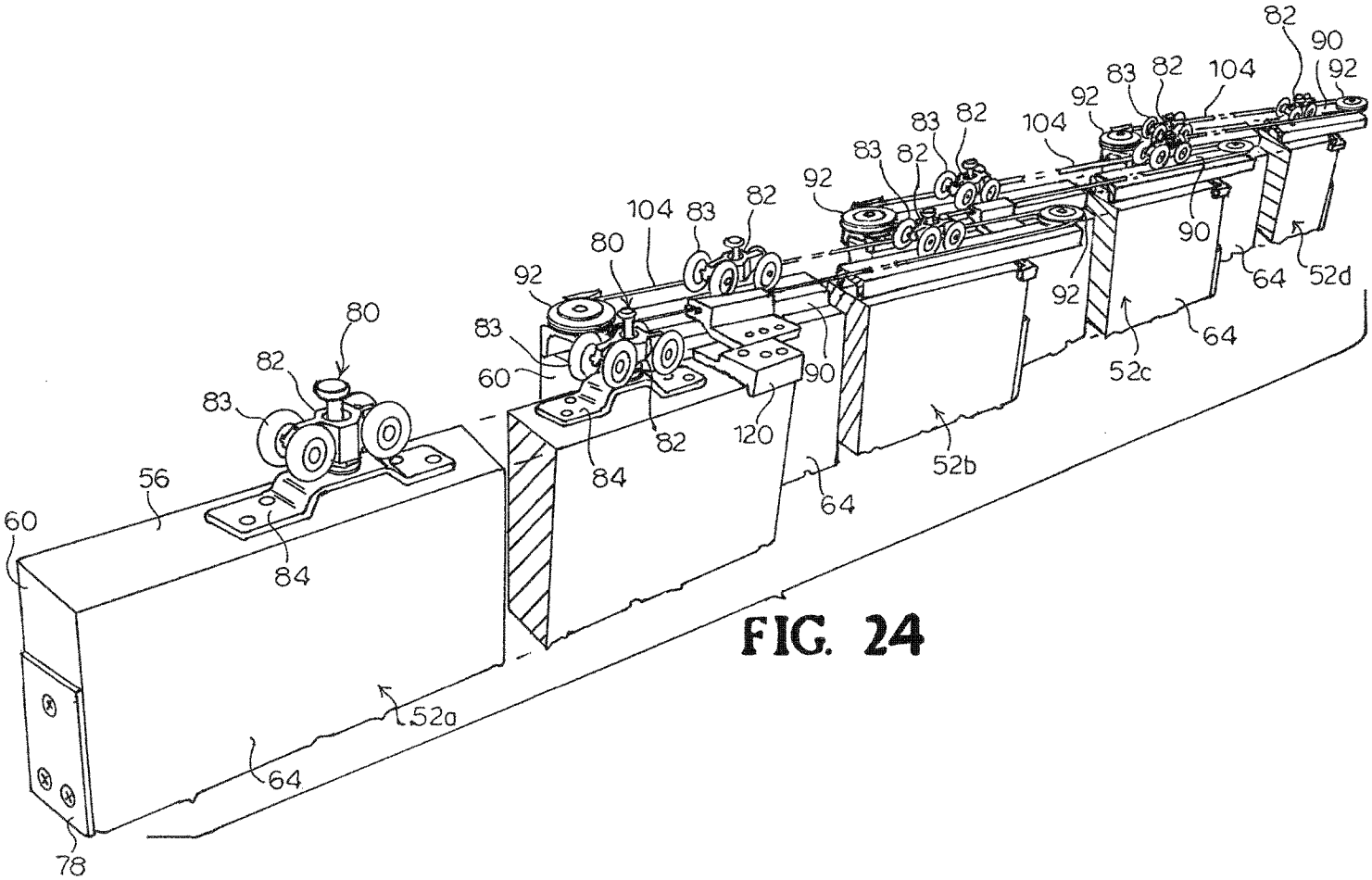
FIG. 24 is an inner perspective view of the embodiment of the telescoping door assembly in the third position as shown in FIG. 23 with portions of the door panels cut away.
Figure 25:
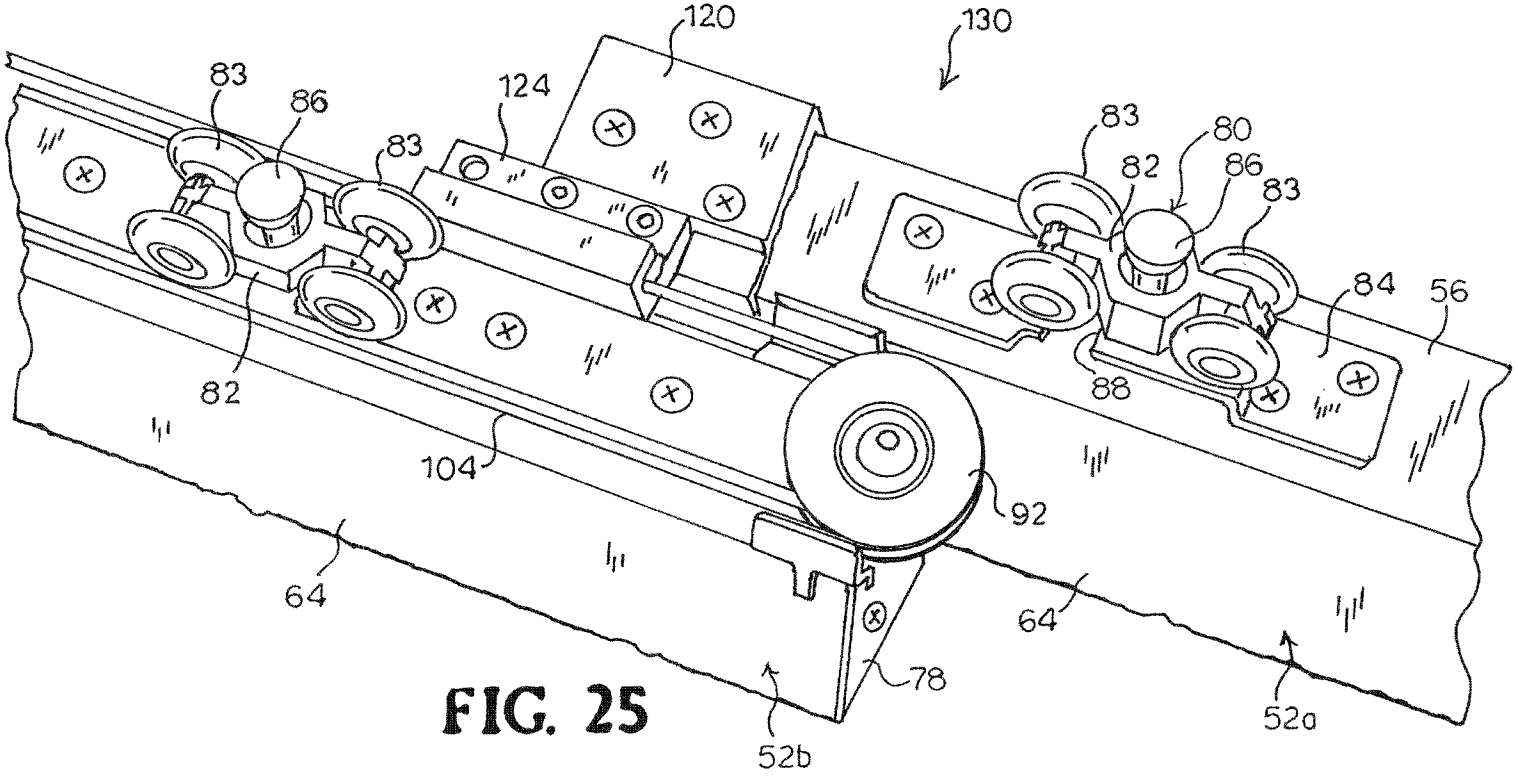
FIG. 25 is a close-up top plan view of an inner end of a leading door panel and an outer end of a first middle door panel of the door assembly as shown in FIG. 23.

In use, the door panels 52 of this embodiment of the door assembly 130 are aligned and contiguous in their innermost position for example, in the pocket of a wall as shown in FIG. 17. Referring to FIGS. 21-23, when the leading door panel 52 is pulled from the pocket, the cable 104 of the first middle door panel 52 will rotate with the linear outward movement of the leading door panel 52 because the leading door panel is secured to the cable 104 of the first middle door by the second cable clamp 124. As described above, the first middle door panel 52 is fixed to the cable 104 of the second middle door panel 52, and the second middle door panel 52 is secured to the cable of trailing door panel 52. In addition, the fifth embodiment of the cable clamp 136 fixes the cable 104 of the trailing door panel 52 to the guide track 54. Accordingly, the first and second middle door panels and the trailing door panel also advance at the same rate as the leading door panel. Thus, the position of the leading door panel 52 relative to the first and second middle door panels 52 and the trailing door panel 52 will change at the same rate as the relative position of the leading door panel 52 to the first middle door panel. This arrangement provides for the telescoping effect to the outward movement of all of the door panels of the door assembly 130. In this door assembly 130, the trailing door panel 52 moves with the other door panels 52 and is not dragged outwardly. Returning the door panels to the first position in the pocket is in the reverse order.

Figure 26:
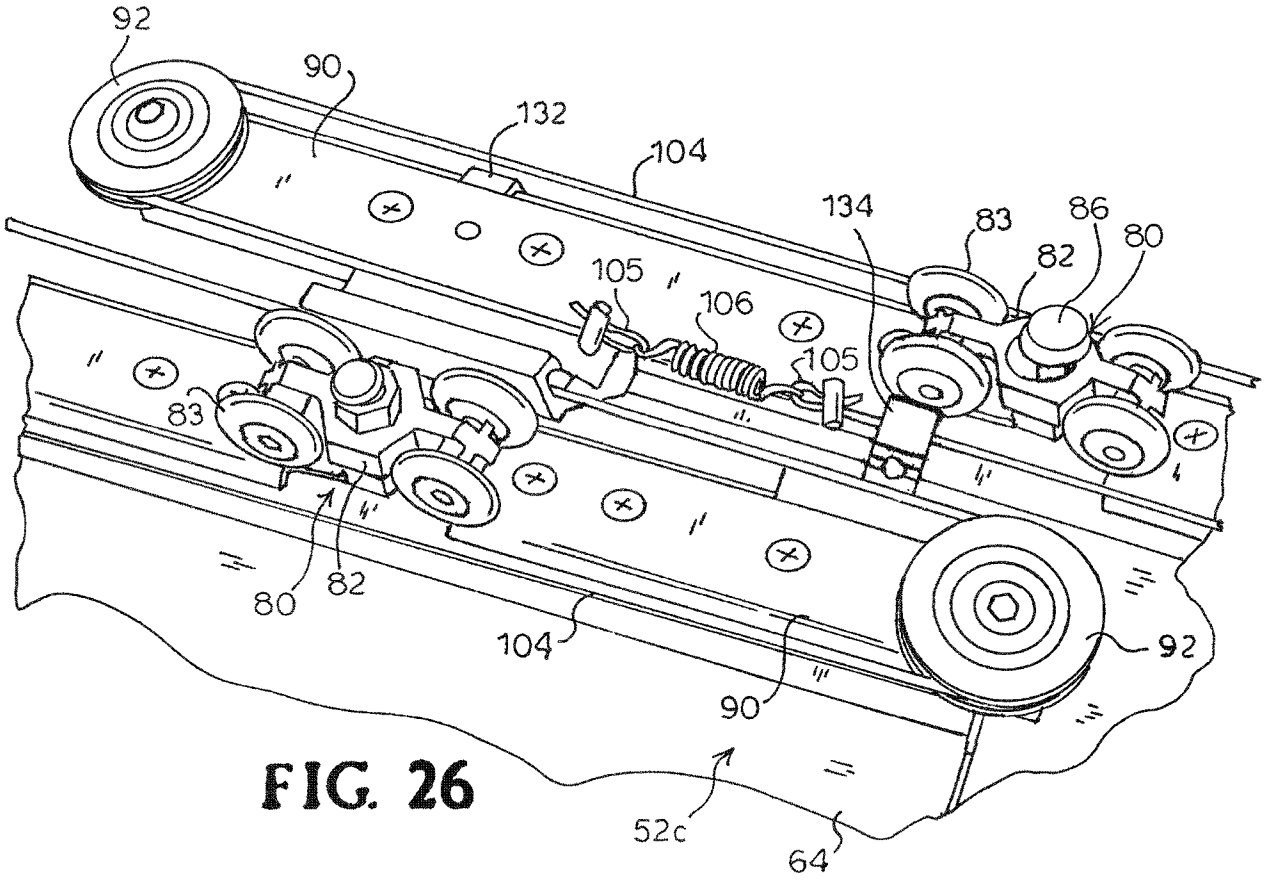
FIG. 26 is a close-up top perspective view of an inner end of a second middle door panel and an outer end of a trailing door panel of the door assembly as shown in FIG. 23.
Figure 27A:
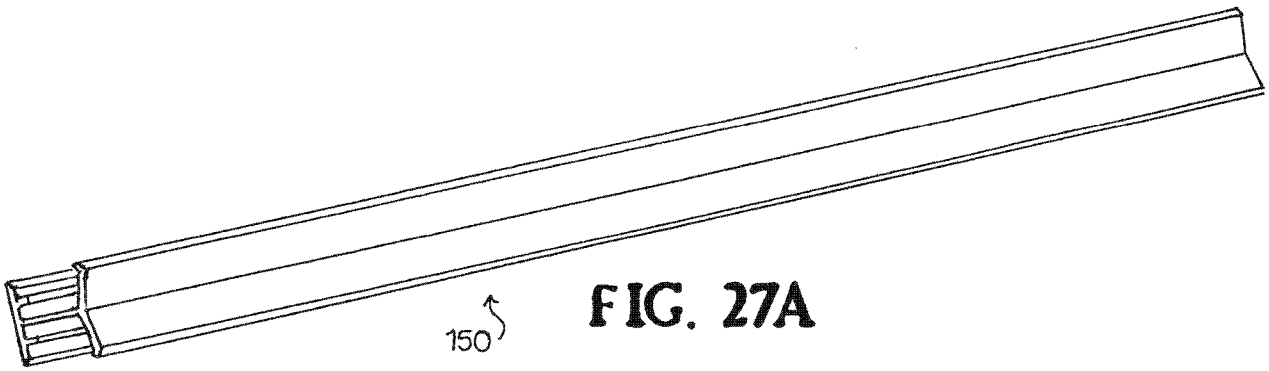
FIG. 27A is a top perspective view of a spacer for use in connecting guide tracks as shown in FIG. 4.
Figure 27B:
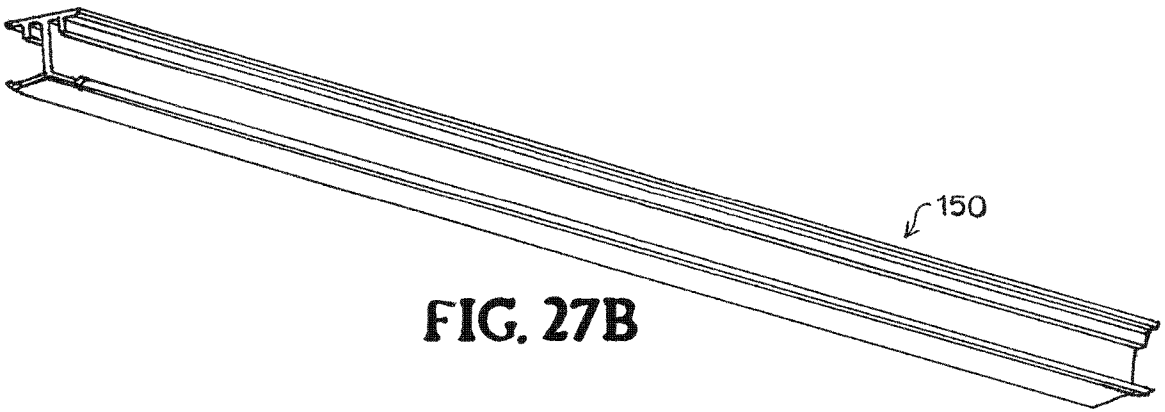
FIG. 27B is a front perspective view of the spacer as shown in FIG. 27A.

On occasion, there may be a requirement to mount two or more guide tracks 54 in parallel relation. In these instances, a spacing member 150 can be mounted with respect to each pair of adjacent guide tracks 54 to effect the predetermined parallel spaced relationship. FIG. 26 illustrates the combination of a pair of guide tracks 54 held in a predetermined parallel relation by a track spacing member 150. The spacing member 150 is configured to be mounted between the pair of guide tracks so as to retain the guide tracks in a predetermined parallel relationship.

The bracket assembly 55 has many advantages, including combining at least two hangers and a multitude of other door hardware for sliding and telescoping doors into one bracket. The bracket establishes correct spacing on the top edge of a sliding and folding door. The bracket also provides correct spacing and fixtures for other door components, such as stops, soft close, telescoping hardware, and the like. Therefore, the new bracket drastically reduces installation time for sliding doorways and, particularly, when such doors incorporate telescoping and other special hardware.

Although the telescoping door hardware has been shown and described in considerable detail with respect to only a few exemplary embodiments thereof, it should be understood by those skilled in the art that we do not intend to limit the description to the embodiments since various modifications, omissions and additions may be made to the disclosed embodiments without materially departing from the novel teachings and advantages of the door hardware, particularly in light of the foregoing teachings. Accordingly, we intend to cover all such modifications, omission, additions and equivalents as may be included within the spirit and scope of the description of the door hardware as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

I claim:

1. A sliding door assembly comprising:

an upper guide track;

a first door panel and a plurality of secondary door panels, each of the door panels having a top end, a bottom end, a leading edge and a trailing edge, and an outer periphery, each of the door panels is slidably supported by a portion of the upper guide track for movement along the track in a first closing direction and a second opening direction;

a monolithic bracket mounted to the top end of the first door panel, the bracket having a width less than a width of the top end of the first door panel, wherein the bracket defines a plurality of openings for receiving fasteners for securing the bracket to the top end of the first door panel, and wherein the bracket further defines at least one opening receiving at least one roller mechanism;

wherein each of the secondary door panels includes at least one roller mechanism, each of the at least one roller mechanisms being slidably received within the upper guide track;

a pair of pulleys secured to the bracket such that the pulleys of the pair of pulleys are in a spaced relationship relative to each other the pair of pulleys guiding an endless cable for rotation around the pulleys; and means for securing the secondary door panels to the cable, wherein, when the door assembly is in a retracted position, the leading edges of the door panels are generally aligned and a first one of the secondary door panels is secured to the cable adjacent the leading edge of the first door panel and a second one of the secondary door panels is secured to the cable adjacent the trailing edge of the first door panel.

2. The sliding door assembly according to claim 1, wherein the upper guide track includes channels, and wherein each of the at least one roller mechanisms is received within a respective one of the channels.

3. The sliding door assembly according to claim 2, wherein the channels are downwardly opening channels.

4. The sliding door assembly according to claim 1, wherein the bracket further comprises alignment tabs for aligning the bracket relative to the top end of the first door panel.

* * * * *